US009103205B2

(12) United States Patent
Wright et al.

(10) Patent No.: US 9,103,205 B2
(45) Date of Patent: Aug. 11, 2015

(54) METHOD OF RECOVERING HYDROCARBON RESOURCES WHILE INJECTING A SOLVENT AND SUPPLYING RADIO FREQUENCY POWER AND RELATED APPARATUS

(75) Inventors: Brian Wright, Indialantic, FL (US); Murray Hann, Malabar, FL (US); Mark Trautman, Melbourne, FL (US); Steven Stresau, Malabar, FL (US)

(73) Assignee: HARRIS CORPORATION, Melbourne, FL (US)

( * ) Notice: Subject to any disclaimer, the term of this patent is extended or adjusted under 35 U.S.C. 154(b) by 395 days.

(21) Appl. No.: 13/548,750

(22) Filed: Jul. 13, 2012

(65) Prior Publication Data

US 2014/0014324 A1 Jan. 16, 2014

(51) Int. Cl.
*E21B 43/241* (2006.01)
*E21B 43/25* (2006.01)

(52) U.S. Cl.
CPC ..... *E21B 43/25* (2013.01)

(58) Field of Classification Search
CPC . E21B 43/162; E21B 43/2408; E21B 43/241; E21B 43/2401; E21B 36/005
USPC ..... 166/248, 65.1, 263, 302, 305.1
See application file for complete search history.

(56) References Cited

U.S. PATENT DOCUMENTS 4,199,025 A * 4/1980 Carpenter ..... 166/248
4,362,213 A 12/1982 Tabor
4,456,065 A * 6/1984 Heim et al. ..... 166/248
4,597,441 A 7/1986 Ware et al.
4,790,375 A * 12/1988 Bridges et al. ..... 166/60
6,189,611 B1 * 2/2001 Kasevich ..... 166/248
6,318,464 B1 * 11/2001 Mokrys ..... 166/252.1
6,649,888 B2 * 11/2003 Ryan et al. ..... 219/634
7,441,597 B2 10/2008 Kasevich
7,484,561 B2 2/2009 Bridges
7,891,421 B2 * 2/2011 Kasevich ..... 166/247
8,176,982 B2 5/2012 Gil et al.
8,616,273 B2 * 12/2013 Trautman et al. ..... 166/248
2004/0031731 A1 * 2/2004 Honeycutt et al. ..... 208/402
2004/0074759 A1 * 4/2004 Purta et al. ..... 204/157.15
2006/0283598 A1 * 12/2006 Kasevich ..... 166/302
2007/0137858 A1 * 6/2007 Considine et al. ..... 166/248
2009/0071648 A1 * 3/2009 Hagen et al. ..... 166/272.1

(Continued)

FOREIGN PATENT DOCUMENTS

WO 2012037147 3/2012

OTHER PUBLICATIONS

Schlumberger Oilfield Glossary entries for "steamflood" and "cyclic steam injection", accessed Oct. 16, 2014 via www.glossary.oilfield.slb.com.*

(Continued)

*Primary Examiner* — Blake Michener
(74) *Attorney, Agent, or Firm* — Allen, Dyer, Doppelt, Milbrath & Gilchrist, P.A.

(57) ABSTRACT

A method of recovering hydrocarbon resources in a subterranean formation may include injecting a solvent via a wellbore into the subterranean formation while supplying radio frequency (RF) power from the wellbore and into the subterranean formation. The method may also include recovering hydrocarbon resources via the wellbore and from the subterranean formation while supplying RF power from the wellbore and into the subterranean formation.

20 Claims, 7 Drawing Sheets

(56) References Cited

U.S. PATENT DOCUMENTS

| | | | | |
|---|---|---|---|---|
| 2009/0194280 | A1* | 8/2009 | Gil et al. | 166/267 |
| 2009/0242196 | A1* | 10/2009 | Pao | 166/248 |
| 2010/0078163 | A1* | 4/2010 | Banerjee et al. | 166/248 |
| 2010/0294488 | A1 | 11/2010 | Wheeler et al. | |
| 2010/0294489 | A1 | 11/2010 | Dreher, Jr. et al. | |
| 2011/0253368 | A1 | 10/2011 | Banerjee et al. | |
| 2011/0284231 | A1* | 11/2011 | Becker | 166/310 |
| 2011/0309988 | A1* | 12/2011 | Parsche | 343/793 |
| 2012/0061080 | A1* | 3/2012 | Sultenfuss et al. | 166/302 |
| 2012/0061081 | A1 | 3/2012 | Sultenfuss et al. | |
| 2012/0067572 | A1* | 3/2012 | Trautman et al. | 166/272.3 |
| 2012/0085533 | A1 | 4/2012 | Madison et al. | |
| 2012/0085537 | A1* | 4/2012 | Banerjee et al. | 166/272.3 |
| 2012/0118565 | A1* | 5/2012 | Trautman et al. | 166/272.6 |
| 2012/0234536 | A1* | 9/2012 | Wheeler et al. | 166/272.1 |
| 2012/0305239 | A1* | 12/2012 | Sultenfuss et al. | 166/248 |
| 2013/0008651 | A1* | 1/2013 | Trautman et al. | 166/272.3 |
| 2013/0048277 | A1* | 2/2013 | Parsche et al. | 166/272.1 |
| 2013/0048278 | A1* | 2/2013 | Parsche et al. | 166/272.3 |
| 2013/0048297 | A1* | 2/2013 | Parsche et al. | 166/369 |
| 2013/0153210 | A1* | 6/2013 | Menard et al. | 166/248 |
| 2013/0180729 | A1* | 7/2013 | Wright et al. | 166/380 |
| 2013/0199774 | A1* | 8/2013 | Sultenfuss et al. | 166/248 |
| 2014/0014316 | A1 | 1/2014 | Blue et al. | |
| 2014/0014325 | A1 | 1/2014 | Blue et al. | |
| 2014/0014326 | A1 | 1/2014 | Blue et al. | |
| 2014/0014494 | A1 | 1/2014 | Blue et al. | |

OTHER PUBLICATIONS

Dictionary definition of "solvent", accessed Oct. 15, 2014 via thefreedictionary.com.*

Schlumberger Oilfield Glossary entries for "bitumen", "hydrocarbon", and "tar sand", accessed Jan. 12, 2015 via www.glossary.oilfield.slb.com.*

* cited by examiner

METHOD OF RECOVERING HYDROCARBON RESOURCES WHILE INJECTING A SOLVENT AND SUPPLYING RADIO FREQUENCY POWER AND RELATED APPARATUS

FIELD OF THE INVENTION

The present invention relates to the field of hydrocarbon resource processing, and, more particularly, to hydrocarbon resource processing methods using radio frequency application and related devices.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam and some connate water in the formation. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

U.S. Patent Application Publication No. 2011/0309988 to Parsche discloses a continuous dipole antenna. More particularly, Parsche disclose a shielded coaxial feed coupled to an AC source and a producer well pipe via feed lines. A non-conductive magnetic bead is positioned around the well pipe between the connection from the feed lines.

U.S. Patent Application Publication No. 2012/0085533 to Madison et al. discloses combining cyclic steam stimulation with RF heating to recover hydrocarbons from a well. Steam is injected into a well followed by a soaking period wherein heat from the steam transfers to the hydrocarbon resources. After the soaking period, the hydrocarbon resources are collected, and when production levels drop off, the condensed steam is revaporized with RF radiation to thus upgrade the hydrocarbon resources.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which may impact the environment. Limited water resources may also limit oil recovery. SAGD is also not an available process in permafrost regions, for example, or in areas that may lack sufficient cap rock, are considered "thin" payzones, or payzones that have interstitial layers of shale.

Additionally, production times and efficiency may be limited by post extraction processing of the recovered oil. More particularly, oil recovered may have a chemical composition or have physical traits that may require additional or further post extraction processing as compared to other types of oil recovered.

SUMMARY OF THE INVENTION

In view of the foregoing background, it is therefore an object of the present invention to more efficiently recover hydrocarbon resources from a subterranean formation and while potentially using less energy and providing faster recovery of the hydrocarbons.

This and other objects, features, and advantages in accordance with the present invention are provided by a method of recovering hydrocarbon resources in a subterranean formation. The method includes injecting a solvent via a wellbore into the subterranean formation while supplying radio frequency (RF) power from the wellbore and into the subterranean formation. The method also includes recovering hydrocarbon resources via the wellbore and from the subterranean formation while supplying RF power from the wellbore and into the subterranean formation. Accordingly, from a single wellbore, the hydrocarbon resource is heated in the subterranean formation while being treated and recovered. This may advantageously increase hydrocarbon resource recovery efficiency, and thus reduce overall production times. For example, implementing the method described herein in each of two wellbores may reduce production times by more than half as compared to the SAGD recovery technique.

The injecting of the solvent and the recovering of the hydrocarbon resources may be cycled over time. The method may further include supplying RF power from the wellbore into the subterranean formation prior to injecting the solvent, for example.

The supplying of RF power during injecting the solvent and recovering the hydrocarbon resources may include supplying RF power to a transmission line coupled to an electrically conductive well pipe within the wellbore. The electrically conductive well pipe may have openings therein to pass the solvent and the hydrocarbon resources.

The subterranean formation may have a payzone therein. The wellbore may extend laterally in the payzone, for example, and the payzone may have a vertical thickness of less than 10 meters.

The supplying of RF power during injecting the solvent and recovering the hydrocarbon resources may include supplying RF power to heat the subterranean formation to a temperature in a range of 50-200° C., for example. The method may further include controlling conditions within the wellbore so that the solvent changes from a liquid phase to a gas phase upon percolating back toward the wellbore.

The recovering of the hydrocarbon resources may include operating a pump within the wellbore, for example. The method may further include reducing an amount of RF power supplied over time.

An apparatus aspect is directed to an apparatus for recovering hydrocarbon resources in a subterranean formation. The apparatus includes a radio frequency (RF) source and an electrically conductive well pipe to be positioned within a wellbore of the subterranean formation and coupled to the RF source to supply RF power into the subterranean formation. The electrically conductive pipe has openings therein to pass a solvent and hydrocarbon resources. The apparatus also includes a solvent source coupled to the electrically conductive well pipe and configured to inject a solvent into the subterranean formation while RF power is supplied thereto. The apparatus further includes a recovery pump coupled to the electrically conductive well pipe and configured to recover hydrocarbon resources from the subterranean formation while RF power is supplied thereto.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
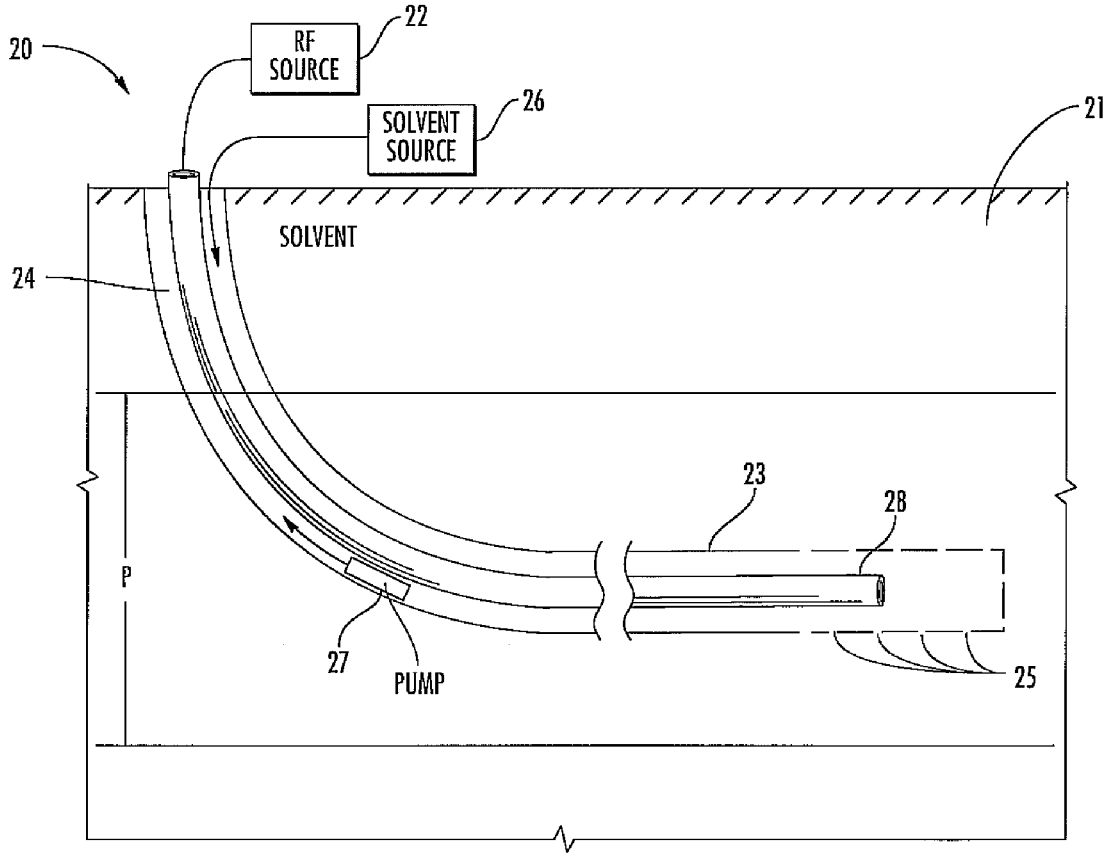
FIG. 1 is a schematic diagram of a subterranean formation including an apparatus for recovering hydrocarbon resources in accordance with the present invention.
Figure 2:
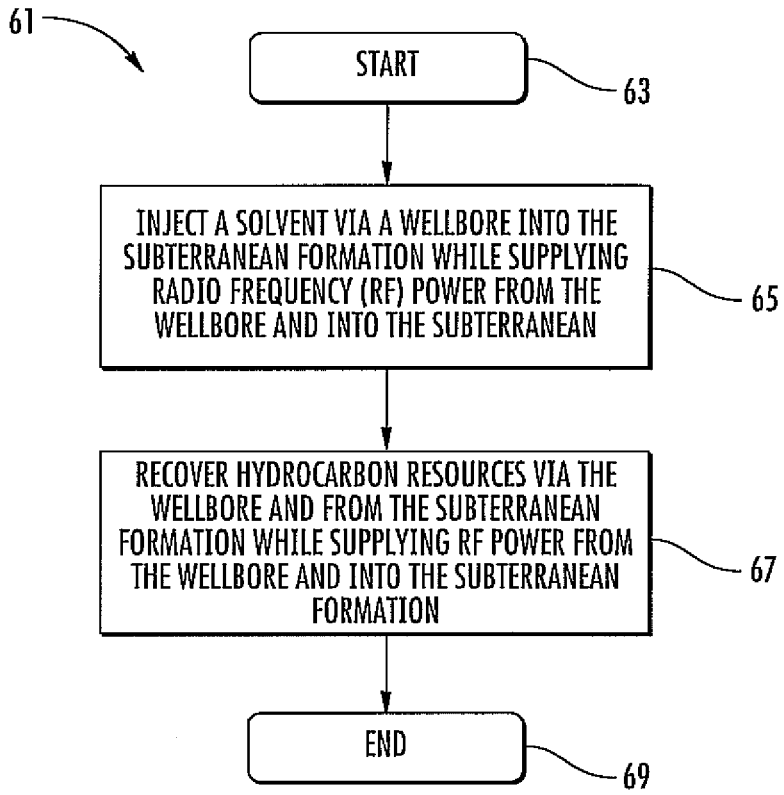
FIG. 2 is a flow chart illustrating a method of recovering hydrocarbon resources using the apparatus in FIG. 1 in accordance with the present invention.

Referring initially to FIG. 1 and the flowchart 61 in FIG. 2, a method of recovering hydrocarbon resources in a subterranean formation 21 is described. The subterranean formation 21 includes a wellbore 24 therein. The wellbore 24 illustratively extends laterally within the subterranean formation 21. In some embodiments, the wellbore 24 may be a vertically extending wellbore, for example, and may extend vertically in the subterranean formation 21. The subterranean formation 21 has a payzone P therein. The wellbore 24 extends laterally in the payzone P. The payzone P is illustratively a relatively thin payzone, having a thickness of less than 10 meters, for example. Of course, the payzone P may have another thickness, for example, between 30-40 meters.

Beginning at Block 63, the method includes injecting a solvent via the wellbore 24 into the subterranean formation 21 while supplying radio frequency (RF) power from the wellbore and into the subterranean formation (Block 65). The method further includes recovering hydrocarbon resources via the wellbore 24 and from the subterranean formation 21 while supplying RF power from the wellbore and into the subterranean formation (Block 67). The method ends at Block 69.

Figure 3:
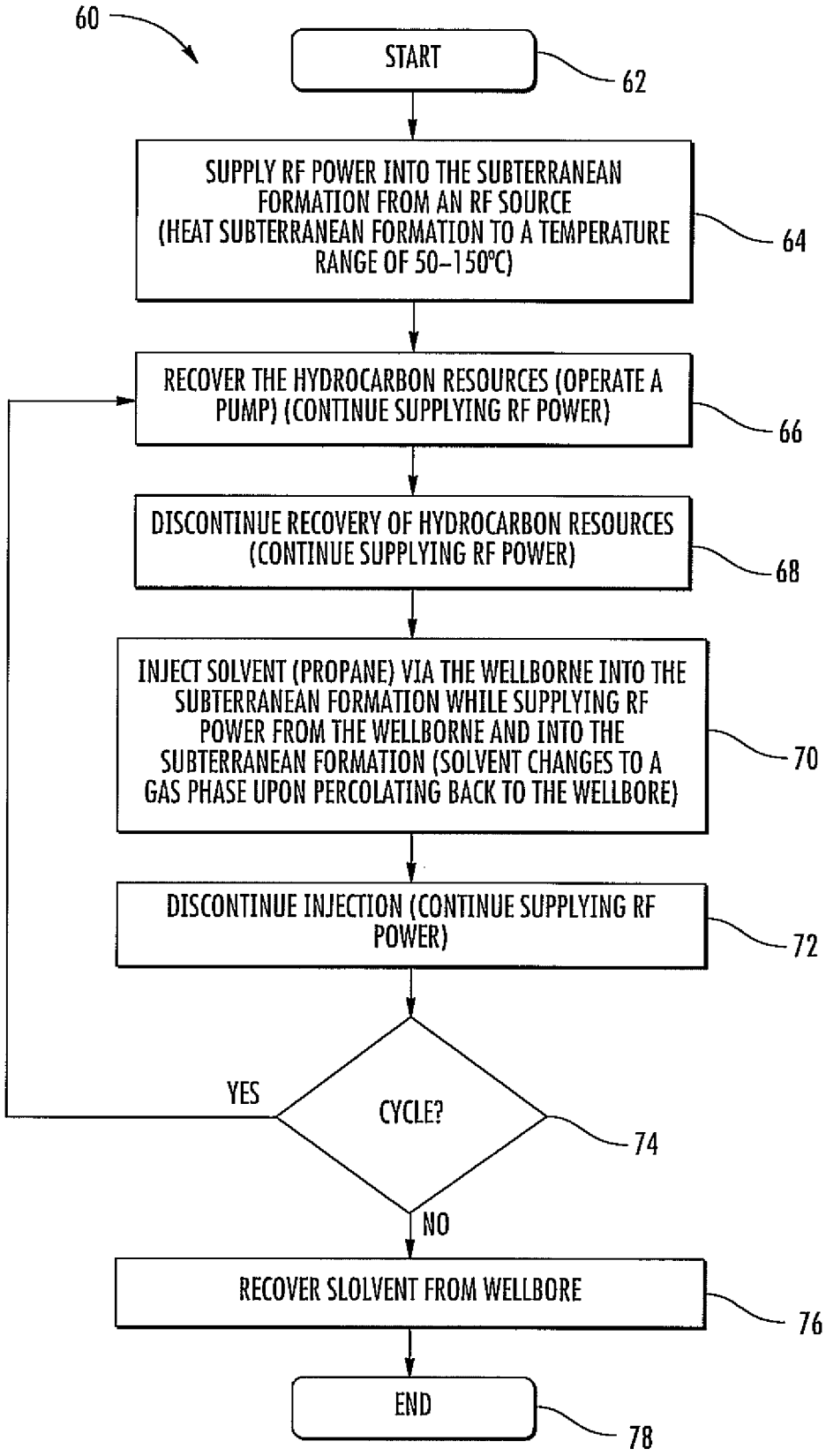
FIG. 3 is a flow chart illustrating a method of recovering hydrocarbon resources using the apparatus in FIG. 1 in accordance with another embodiment of the present invention.

Referring now to FIG. 1 and the flowchart 60 in FIG. 3, another method of recovering hydrocarbon resources in a subterranean formation 21 according to another embodiment is described. Beginning at Block 62, the method at Block 64 includes supplying RF power into the subterranean formation 21 from an RF source 22. The RF source is positioned above the subterranean formation 21. More particularly, the RF power is supplied from the RF source 22 to an RF transmission line 28 within and coupled to an electrically conductive well pipe 23. The RF transmission line 28 may be coaxial transmission line, for example. The RF transmission line 28 may have a tubular shape, for example, to allow for equipment, sensors, etc. to be passed therethrough. More particularly, a temperature sensor and/or a pressure may be positioned within the RF transmission line 28. A temperature and/or a pressure sensor may alternatively or additionally be positioned within the electrically conductive well pipe 23 to read temperatures and pressures of the subterranean formation 21 via the openings 25. For example, a temperature and/or pressure sensor may be coupled to an exterior surface of the RF transmission line 28.

The electrically conductive well pipe 23 may be a wellbore liner, for example, and may include slots or openings 25 therein to allow the passage of the hydrocarbon resources and other fluid or gasses, as will be described in further detail below. The electrically conductive well pipe 23 advantageously defines an RF antenna, for example, a dipole antenna. Of course, the electrically conductive well pipe 23 may define other types of antennas, and the transmission line 28 may be coupled to the electrically conductive well pipe in other configurations.

The supplying of RF power (Block 64) may be considered part of a pre-heat or startup phase. During the startup phase, the RF antenna 23 supplies RF power to preheat the payzone P within the subterranean formation 21 to a temperature to where the hydrocarbon resources, for example, bitumen, become mobile. Desiccation occurs around the antenna 23 and generates steam. When the steam surrounds or encompasses the antenna 23, the impedance of the antenna is stabilized. In other words, RF power and frequency are modulated to provide impedance changes within transmission matching limits.

At Block 66, as part of the startup phase, the hydrocarbon resources are recovered. The antenna 23 advantageously functions as producer, and the hydrocarbon resources are produced at a relatively low rate due to thermal expansion and steam driving. The hydrocarbon resources are recovered via the electrically conductive well pipe 23 by using a recovery pump 27. The recovery pump 27 may be a submersible pump, for example, and positioned within the electrically conductive well pipe. In some embodiments, the recovery pump 27 may be positioned above the subterranean formation 21. The recovery pump 27 may be an artificial gas lift (AGL), or other type of pump, for example, using hydraulic or pneumatic lifting techniques. In some embodiments, the amount of RF power supplied may be reduced during operation of the recovery pump 27.

The startup phase may have a duration of about 2 to 3 months, for example. Of course, the startup phase may have another duration, for example, based upon the type of hydrocarbon resources, the subterranean formation 21, and/or the size of the payzone P.

During a second phase following the startup phase, the wellbore 24 is switched from a production mode of operation to an injection mode of operation. At Block 68, as part of the second phase, recovery of the hydrocarbon resources are discontinued, i.e. operation of the recovery pump 27 is stopped. At Block 70 a solvent is injected via the wellbore 24 into the subterranean formation 21 while supplying RF power from the wellbore and into the subterranean formation. More particularly, the solvent is injected from a solvent source 26 above the subterranean formation 21 into the electrically conductive well pipe 23 or antenna. The solvent may be propane, for example. Of course, the solvent may include other or additional substances. Supplying of RF power is continued throughout the second phase, i.e., the discontinuation of the recovery and the injection of the solvent.

The solvent advantageously reduces the native viscosity of or thins the hydrocarbon resources. Additionally, the solvent volumetrically replaces the recovered hydrocarbons. The temperature, for example, of the RF transmission line 28, and the electrically conductive well pipe 23 may also be reduced. In some embodiments, the RF transmission line 28 may also include a cooling system. A lower operating temperature may correspond to a smaller transmission line, for example, and may thus reduce costs. For example, the RF power may be supplied to heat the subterranean formation 21 to a temperature in the range of 50-200° C. Of course, the temperature of the subterranean formation 21 may be heated to a desired temperature that may be considered optimal based upon the wellbore 24 or reservoir conditions, for example. Indeed, at temperatures greater than 150° C., components of the RF transmission line 28 and RF antenna 23 may begin to breakdown, especially dielectric materials. Moreover, at lower temperatures performance of the RF transmission line 28 may be increased, for example, conductivity. The cooling system noted above may be particularly advantageous for further protecting the RF transmission line 28, and more particularly, the dielectric materials when temperatures are greater than 150° C. In effect, a cooling system may allow the RF transmission line 28 to operate at a temperatures that may be higher than a desired operating temperature for the RF transmission line.

The second phase of solvent injection may continue for several weeks following the startup phase. Of course, the second phase may have a longer or shorter duration.

During a third phase or cycling phase following the second phase, the mode of operation of the wellbore 24 is alternated or cycled between production and injection. More particularly, at Block 72 the injection of the solvent is discontinued. If cycling is to start or continue (Block 74), the method then returns to Block 66 where the recovery pump 27 is again operated to recover hydrocarbon resources via the electrically conductive well pipe 23 and from the subterranean formation 21. RF power is continued to be supplied from the RF antenna 23 and into the subterranean formation during the recovery. The duty cycle of the switching between injection and recovery may be varied to maintain desired operating conditions, for example, temperature, as described above.

Additionally, pressure within the wellbore may also be controlled by "throttling" (i.e., pressure and flow control) of the hydrocarbon resources produced during the production mode. In some embodiments, the amount of RF power supplied during the cycling phase may be reduced over time. For example, conditions within the wellbore 24 may be controlled so that the solvent changes from a liquid phase to a gas phase upon percolating back toward the wellbore (solvent "re-flash" or "reflux"). In other words, during the recovery operations of the cycling phase while still supplying RF power, gas production at the down-hole conditions may be restricted to allow for solvent to flash to a gas in-situ and re-infiltrate the hydrocarbon resources. Limiting gas production during the recovery of the hydrocarbon resources may maintain reservoir or wellbore pressure and may reduce over-production of the solvent. In other words, this "throttling" allows the solvent to be re-used in the wellbore, thus lowering the amount of solvent returned to surface, which is typically separated and returned to the wellbore. This is in effect recycling the solvent at the wellbore site, thus further increasing efficiency and reducing costs.

The third or cycling phase may continue for one to twenty-five years. Of course, the third phase may have another duration.

A fourth phase of operation is a blow down phase. More particularly, after injection of the solvent is discontinued (Block 72) and it is determined that cycling should be discontinued (Block 74), the rate of gas production is increased, as RF power may or may not be supplied from the antenna 23, no solvent is injected, and hydrocarbon resources may or may not be recovered. At Block 76, the injected solvent is recovered from the wellbore 24. Any of a number of solvent recovery techniques may be used to recover the solvent from the wellbore 24. However, an inert gas, for example, nitrogen, may be injected into the wellbore 24 to assist in solvent recovery.

Indeed, the method of hydrocarbon resource recovery described herein may be particularly advantageous for a subterranean formation having a relatively thin payzone, for example, less than 10 meters. Using a single wellbore for both injection and recovery while supplying RF power may be particularly advantageous over the SAGD production technique, for example, which is typically not well suited for use with a subterranean formation having a relatively thin payzone.

More particularly, a thin payzone is generally not considered economically viable for recovery in a typical SAGD formation, as the capital investment generally outweighs the oil recovered from a thin payzone. With a lower capital investment, the method of the embodiments described herein using a "single bore" recovery concept may be economically viable for a thin payzone.

Additionally, from a functional installation standpoint, the present embodiments may be particularly advantageous. For example, a typical SAGD injector well to producer well vertical spacing is about 5 meters (the steam injector is separated by about 5 meters from the producer which collects the hydrocarbon resource). And with only a 10 meter thick payzone, it may be increasingly difficult to place the injector and producer wells within that relatively thin, geologically undulating layer.

Moreover, the method described herein uses half the wellbores as compared to SAGD. This decreases production costs, as recovery is based upon a single wellbore. Alternatively, the same amount of wellbores may be used as in SAGD, but production times may be cut by more than half, for example, from 17 years to 7 years. In some embodiments, the spacing between adjacent wellbores may be set to 50 meters instead of 100 meters, for example, to increase hydrocarbon resource recovery or decrease the amount of hydrocarbon resources that remain in the subterranean formation, especially between adjacent wellbores. The method ends at Block 78.

Figure 4A:
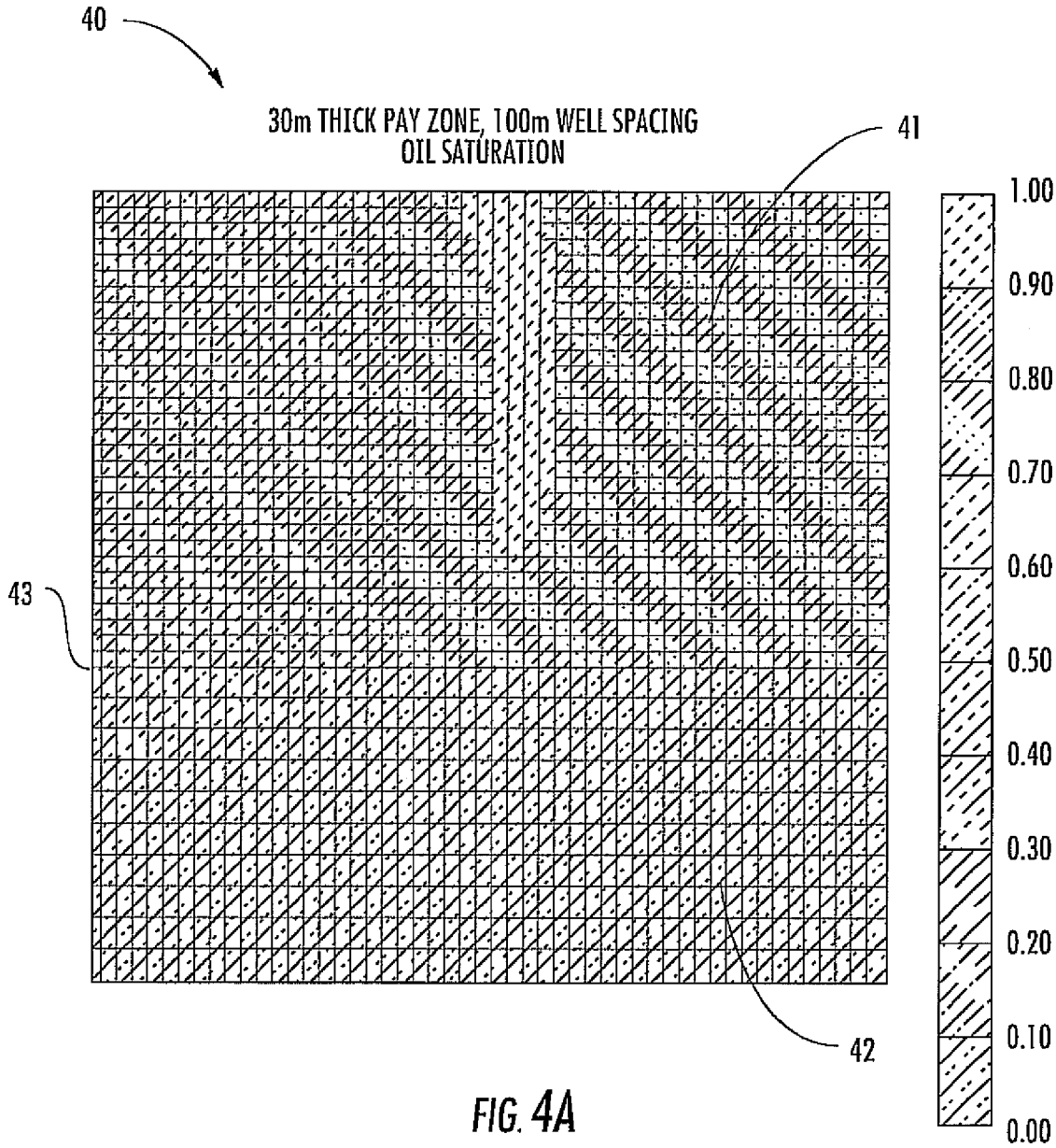
FIGS. 4*a*-4*c* are simulated hydrocarbon resource saturation graphs for the hydrocarbon resource recovery method according to the present invention.

Referring now to the graph 40 in FIG. 4*a*, a simulated hydrocarbon resource saturation graph is illustrated for a 30 meter thick payzone with a 100 meter wellbore spacing. The payzone is corresponds to the line 41, and the under burden corresponds to the line 42. The antenna location is in "point view" (into the page) and corresponds to the line 43. It should be noted that the graph illustrates half of the reservoir, with symmetry on each side of the antenna being used for modeling the entire reservoir.

Figure 4B:
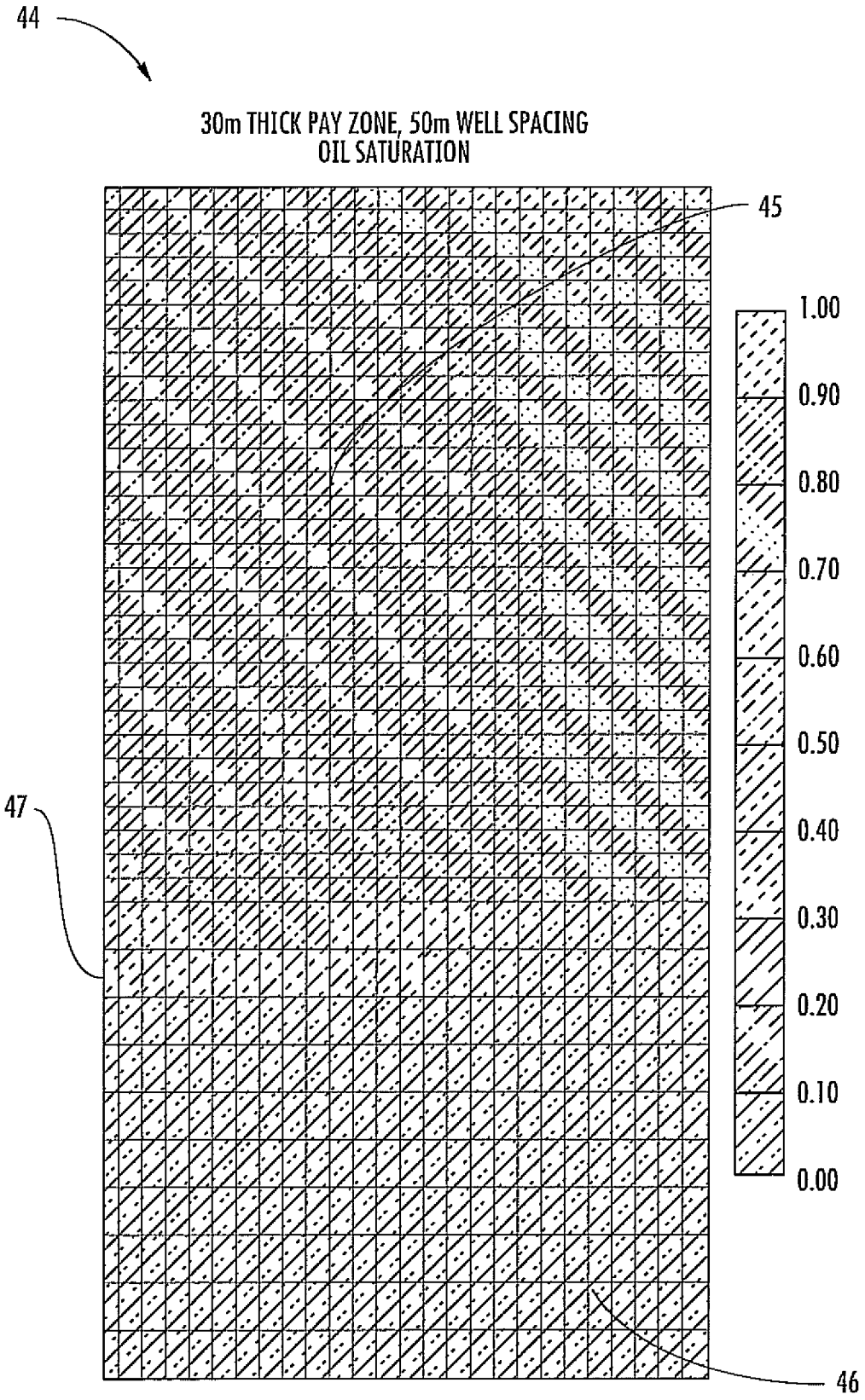
Figure 4C:
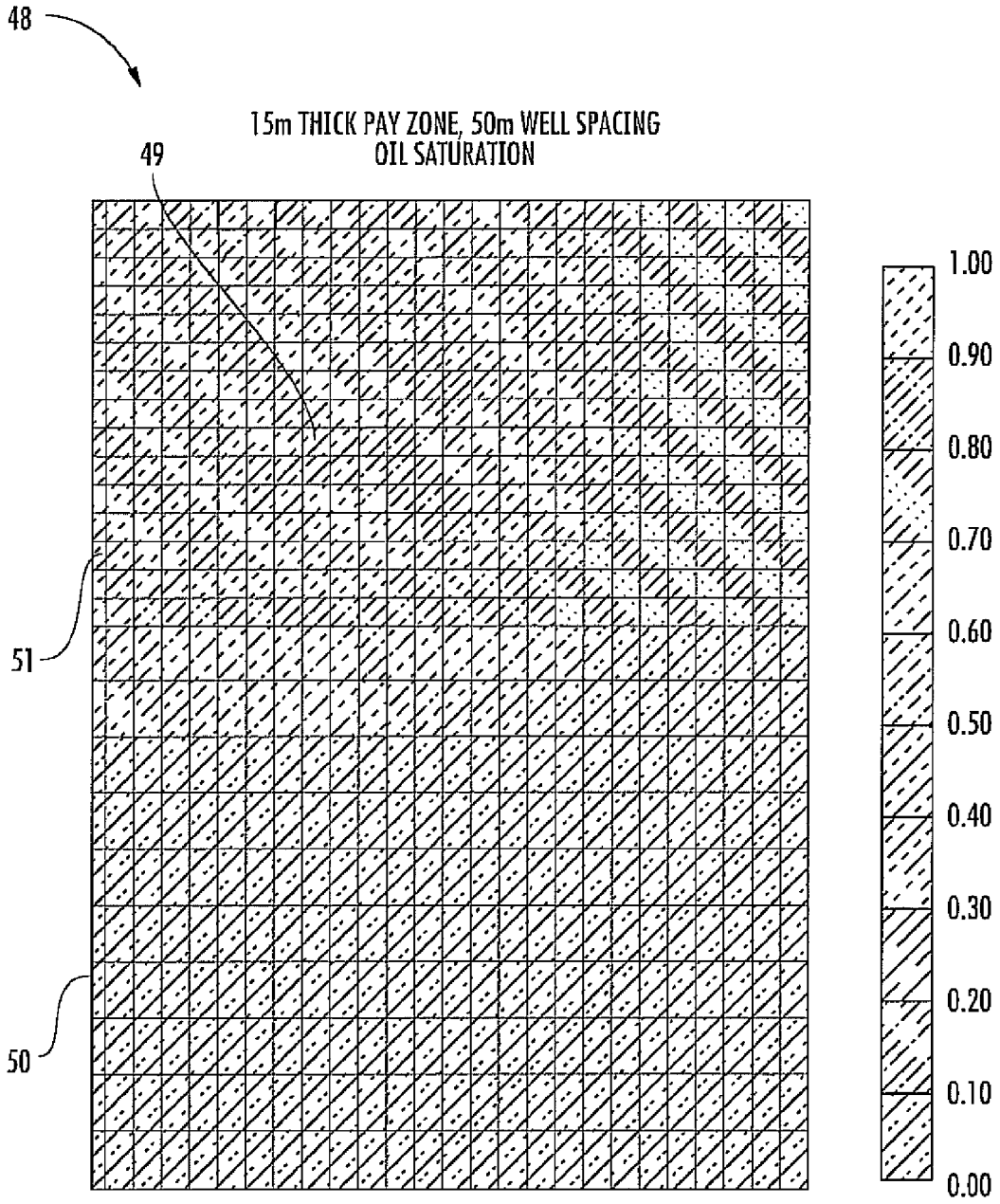

Referring now to the graph 44 in FIG. 4*b*, a simulated hydrocarbon resource saturation graph is illustrated for a 30 meter thick payzone with a 50 meter wellbore spacing. The payzone corresponds to the line 45, and the under burden corresponds to the line 46. The antenna location corresponds to the line 47. Referring now to the graph 48 in FIG. 4*c*, a simulated hydrocarbon resource saturation graph is illustrated for a 15 meter thick payzone with a 50 meter wellbore spacing. The payzone is corresponds to the line 49, and the under burden corresponds to the line 50. The antenna location corresponds to the line 51. Indeed, a single wellbore may be particularly suited for relatively thin payzones. For example, for the same capital cost, a given amount of hydrocarbon resources may be recovered in less than half the time, as compared with a dual wellbore configuration, as in SAGD. Table 1 below summarizes the simulated results for the corresponding graphs in FIGS. 4*a*-4*c*.

TABLE 1

| Configuration | Well Spacing (m) | Heating Time (yr) | Total Time (yr) | Oil produced per 100 m × 1 m ($m^3$/m) | Avg. Oil Production Rate per 100 m × 1 m ($m^3$/d) | Oil Recovery Factor (%) | RF Efficiency (GJ/bbl) | Effective CSOR |
|---|---|---|---|---|---|---|---|---|
| 30 m payzone, 100 m well spacing | 100 | 16 | 22 | 739 | 0.0919 | 96 | 0.205 | 2.03 |
| 30 m payzone 50 m well spacing | 50 | 6 | 14 | 655 | 0.1281 | 85 | 0.191 | 1.89 |
| Thin (14 m) payzone, 50 m well spacing | 50 | 5 | 10 | 319 | 0.0875 | 83 | 0.277 | 2.74 |

Figure 5:
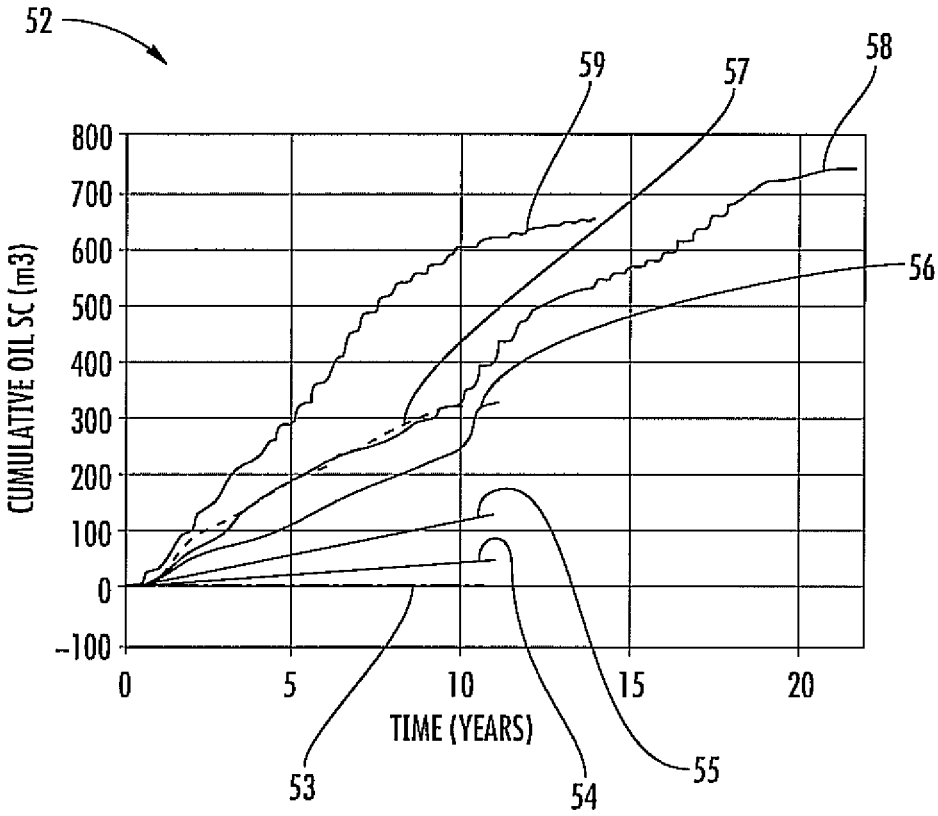
FIG. 5 is a graph comparing prior art hydrocarbon resource recovery methods with a method of hydrocarbon resource recovery according to the present invention.

Referring now to the graph 52 in FIG. 5, a graph of hydrocarbon resource production over time is illustrated. Line 53 corresponds to a baseline production with no RF power being supplying and no injection of a solvent. Line 54 corresponds to a baseline production with no RF power being supplied, but with solvent being injected. Line 55 corresponds to a baseline production with RF power being supplied, but no solvent being injected. Line 56 corresponds to a baseline production with RF power being supplied and solvent being injected. The baseline curves are for a 30 meter thick payzone with a 100 meter wellbore spacing, and the curves are normalized to a 100 meter width by a 1-meter length in a direction horizontal of the wellbore.

Line 57 corresponds to a 15 meter payzone and a 50 meter wellbore spacing with RF power being supplied and solvent being injected. Line 58 corresponds to a 30 meter payzone and a 100 meter wellbore spacing with RF power being supplied and solvent being injected. Line 59 corresponds to a 30 meter payzone and 50 meter wellbore spacing with a RF power being applied and solvent being injected. Illustratively, the line 59 yields increased cumulative hydrocarbon resource production with respect to time.

An apparatus aspect is directed to an apparatus 20 for recovering hydrocarbon resources in a subterranean formation 21. The apparatus 20 includes a radio frequency (RF) source 22 and an electrically conductive well pipe 23 to be positioned within a wellbore 24 of the subterranean formation 21 and coupled to the RF source to supply RF power into the subterranean formation. The electrically conductive well pipe 23 has openings 25 therein to pass a solvent and hydrocarbon resources. A solvent source 26 is coupled to the electrically conductive well pipe 23 and is configured to inject a solvent into the subterranean formation while RF power is supplied thereto. A recovery pump 27 is coupled to the electrically conductive well pipe 23 and is configured to recover hydrocarbon resources from the subterranean formation 21 while RF power is supplied thereto.

Further details of recovering and upgrading hydrocarbon resources may be found in U.S. patent application Ser. No. 13/548,853, filed Jul. 13, 2012, U.S. patent application Ser. No. 13/548,904, filed Jul. 13, 2012, U.S. patent application Ser. No. 13/548,997, filed Jul. 13, 2012, and U.S. patent application Ser. No. 13/549,038, filed Jul. 13, 2012, each assigned the assignee of the present application, and the entire contents of which are herein incorporated by reference. Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method of recovering hydrocarbon resources in a subterranean formation comprising:

injecting a solvent for hydrocarbons via a wellbore into the subterranean formation while supplying radio frequency (RF) power from the wellbore and into the subterranean formation; and recovering hydrocarbon resources via the wellbore and from the subterranean formation while supplying RF power from the wellbore and into the subterranean formation;

the injecting and the recovering being performed alternatingly while supplying RF power from the wellbore and into the subterranean formation.

2. The method according to claim 1, wherein the injecting of the solvent for hydrocarbons and the recovering of the hydrocarbon resources are cycled over time.

3. The method according to claim 1, further comprising supplying RF power from the wellbore into the subterranean formation prior to injecting the solvent for hydrocarbons.

4. The method according to claim 1, wherein supplying RF power during injecting the solvent for hydrocarbons and recovering the hydrocarbon resources comprises supplying RF power to a transmission line coupled to an electrically conductive well pipe within the wellbore.

5. The method according to claim 4, wherein the electrically conductive well pipe has openings therein to pass the solvent for hydrocarbons and the hydrocarbon resources.

6. The method according to claim 1, wherein the subterranean formation has a payzone therein; and wherein the wellbore extends laterally in the payzone.

7. The method according to claim 6, wherein the payzone has a vertical thickness of less than 10 meters.

8. The method according to claim 1, wherein the supplying RF power during injecting the solvent for hydrocarbons and recovering the hydrocarbon resources comprises supplying RF power to heat the subterranean formation to a temperature in a range of 50-200° C.

9. The method according to claim 1, further comprising controlling conditions within the wellbore so that the solvent for hydrocarbons changes from a liquid phase to a gas phase upon percolating back toward the wellbore.

10. The method according to claim 1, wherein recovering the hydrocarbon resources comprises operating a pump within the wellbore.

11. The method according to claim 1, further comprising reducing an amount of RF power supplied over time.

12. A method of recovering hydrocarbon resources in a subterranean formation having a payzone therein comprising:

injecting a solvent for hydrocarbons, via a wellbore laterally extending in the payzone, into the subterranean formation while supplying radio frequency (RF) power from the wellbore and into the subterranean formation; and recovering hydrocarbon resources via the wellbore and from the subterranean formation while supplying RF power from the wellbore and into the subterranean formation;

the injecting of the solvent for hydrocarbons and the recovering of the hydrocarbon resources being cycled over time by alternating the injecting and the recovery while supplying RF power from the wellbore and into the subterranean formation.

13. The method according to claim 12, further comprising supplying RF power from the wellbore into the subterranean formation prior to injecting the solvent for hydrocarbons.

14. The method according to claim 12, wherein supplying RF power during injecting the solvent for hydrocarbons and recovering the hydrocarbon resources comprises supplying RF power to a transmission line coupled to an electrically conductive well pipe within the wellbore.

15. The method according to claim 12, wherein the supplying RF power during injecting the solvent for hydrocarbons and recovering the hydrocarbon resources comprises supplying RF power to heat the subterranean formation to a temperature in a range of 50-200° C.

16. An apparatus for recovering hydrocarbon resources in a subterranean formation comprising:

a radio frequency (RF) source;

an electrically conductive well pipe to be positioned within a wellbore of the subterranean formation and coupled to said RF source to supply RF power into the subterranean formation, said electrically conductive pipe having openings therein to pass a solvent for hydrocarbons and hydrocarbon resources;

a solvent source for hydrocarbons coupled to said electrically conductive well pipe and configured to inject a solvent for hydrocarbons into the subterranean formation while RF power is supplied thereto; and a recovery pump coupled to said electrically conductive well pipe and configured to recover hydrocarbon resources from the subterranean formation while RF power is supplied thereto;

said solvent source for hydrocarbons and said recovery pump respectively configured to inject the solvent for hydrocarbons and recover the hydrocarbon resources alternatingly while RF power is supplied into the subterranean formation.

17. The apparatus according to claim 16, wherein said solvent source for hydrocarbons and said recovery pump are configured to cycle injection of the solvent for hydrocarbons and of recovery the resources over time.

18. The apparatus according to claim 16, further comprising a transmission line coupled between said electrically conductive well pipe and said RF source.

19. The apparatus according to claim 16, wherein said RF source and said electrically conductive well pipe are configured to heat the subterranean formation to a temperature in a range of 50-200° C.

20. The apparatus according to claim 16, wherein said solvent source for hydrocarbons and said recovery pump are configured to inject the solvent for hydrocarbons and recover the hydrocarbon resources so that the solvent for hydrocarbons changes from a liquid phase to a gas phase upon percolating back toward the wellbore.

* * * * *